United States Patent [19]

Iwai et al.

[11] 4,403,578

[45] Sep. 13, 1983

[54] SEPARATE LUBRICATING SYSTEM FOR OUTBOARD ENGINE

[75] Inventors: Tomio Iwai; Motoi Tobinaga, both of Hamamatsu, Japan

[73] Assignees: Yamaha Hatsudoki Kabushiki Kaisha, Iwata; Sanshin Kogyo Kabushiki Kaisha, Hamamatsu, both of Japan

[21] Appl. No.: 317,347

[22] Filed: Nov. 2, 1981

[30] Foreign Application Priority Data

Nov. 27, 1980 [JP] Japan ..... 55-167823

[51] Int. Cl.[3] ..... F01M 1/00; F01M 1/02; F01M 3/02

[52] U.S. Cl. ..... 123/73 AD; 123/196 R

[58] Field of Search ..... 123/73 AD, 196 CP, 196 R

[56] References Cited

U.S. PATENT DOCUMENTS

| | | | |
|---|---|---|---|
| 2,935,057 | 5/1960 | Perlewitz | 123/73 AD |
| 3,929,110 | 12/1975 | Ralkov et al. | 123/73 AD |
| 4,121,631 | 10/1978 | Jones | 123/73 AD |

FOREIGN PATENT DOCUMENTS

| | | | |
|---|---|---|---|
| 239679 | 5/1960 | Australia | 123/73 AD |
| 3025002 | 2/1981 | Fed. Rep. of Germany | 123/73 AD |
| 1079434 | 5/1954 | France | 123/196 R |
| 2437491 | 5/1980 | France | 123/73 AD |

*Primary Examiner*—Wendell E. Burns
*Attorney, Agent, or Firm*—Ernest A. Beutler

[57] ABSTRACT

A lubricating system for a two cycle engine, particularly of the outboard type, wherein the engine has a separate lubricating system and lubricant is supplied to this system by a relatively small delivery tank via gravity feed. In addition, an arrangement is provided for supplying lubricant to the delivery tank from a separate oil storage tank to maintain a predetermined liquid level in the delivery tank. This system includes a pump located in the separate storage tank. In accordance with certain embodiments of the invention, the pump is operated if the liquid level in the delivery tank falls below a predetermined level. In accordance with one embodiment, the operation of the pump is stopped when the liquid level exceeds a predetermined level.

24 Claims, 7 Drawing Figures

Fig-6
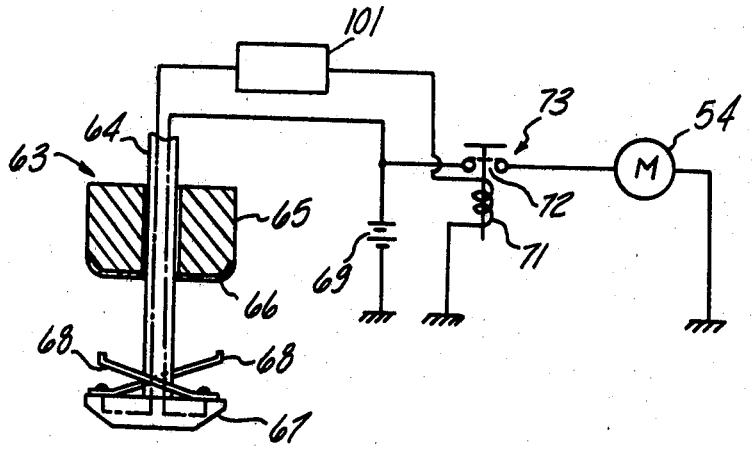
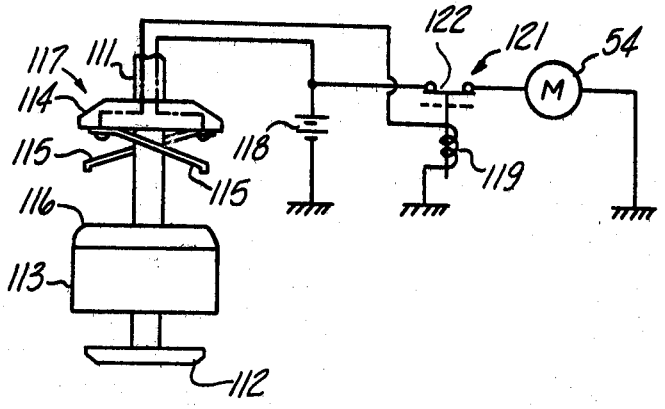
Fig-7

SEPARATE LUBRICATING SYSTEM FOR OUTBOARD ENGINE

BACKGROUND OF THE INVENTION

This invention relates to a separate lubricating system for outboard engines and more particularly to an improved lubricating system for two cycle engines.

In conjunction with two cycle engines, it has been proposed to provide a separate lubricating system wherein the lubricating oil is contained within a separate tank and delivered to the engine lubricating system and eventually the combustion chambers wherein it may be burned after it has served its lubricating function. Such an arrangement overcomes the necessity to mix the lubricating oil with the fuel and further insures more positive lubrication of all components of the engine. However, in many instances the lubricant tank cannot be positioned in such a way so that it can supply the lubricating system of the engine by gravity feed. For example, when the system is used in conjunction with an outboard motor, it is not possible to mount a tank of sufficient capacity directly on the motor so as to provide the desired lubrication, particulary during long running periods. When the engine is of the large displacement type or is operated for long periods of time, it is impossible to provide a tank of sufficient capacity carried directly by the engine.

It has been proposed to eliminate these problems by supplying a separate, external oil tank which supplies either a small tank mounted on the engine or the engine itself by means of a pump. Where the pump is positioned in the engine there is a long supply line from the external tank to the pump. Thus, when the engine is started there is the disadvantage that the pump will have lost its prime or, alternatively, may run for a period of time without actually delivering any lubricating oil until the supply pipe is filled. Of course, this can cause detrimental damage to the engine. Also, such systems are disadvantageous in that the supply of lubricant to the engine will be dependent upon the viscosity of the lubricating oil. Furthermore, when the pump is driven continuously by the engine such systems will deliver more oil than necessary during periods of time when the engine is run at high speeds so as to result in unnecessary lubricating oil consumption.

It is, therefore, a principal object of this invention to provide an improved lubricating system for a two cycle engine.

It is a further object of this invention to provide a lubricating system for two cycle engines wherein a flow of lubricating oil to the engine is insured at all times and unnecessary oil consumption is avoided.

It is a further object of this invention to provide a separate lubricating system for an outboard motor wherein a continuous flow of lubricating oil is insured even during start up operation.

SUMMARY OF THE INVENTION

A first feature of this invention is adapted to be embodied in a lubricating system for a two cycle engine that comprises a lubricant delivery system for delivering lubricant to the engine, a relatively small delivery tank for supplying lubricant therefrom to the lubricant delivery system and a separate larger capacity lubricant storage tank. In accordance with this feature of the invention, pump means are located in the storage tank for pumping lubricant from the storage tank into the delivery tank.

Yet another feature of the invention is also adapted to be embodied in a lubricating system for a two cycle engine of the type described in the preceding paragraph wherein there is a relatively small delivery tank and a separate larger capacity lubricant storage tank and pump means for pumping lubricant from the storage tank to the delivery tank. In accordance with this feature of the invention, means are provided for operating the pump means to maintain at least a predetermined level of oil in the delivery tank.

BRIEF DESCRIPTION OF THE DRAWINGS

FIG. 6 is a schematic electrical diagram, in part similar to FIG. 5, showing a further embodiment of the invention.

FIG. 7 is a schematic electrical diagram, in part similar to FIGS. 5 and 6, showing a still further embodiment of the invention.

DETAILED DESCRIPTION OF THE PREFERRED EMBODIMENTS

Figure 1:
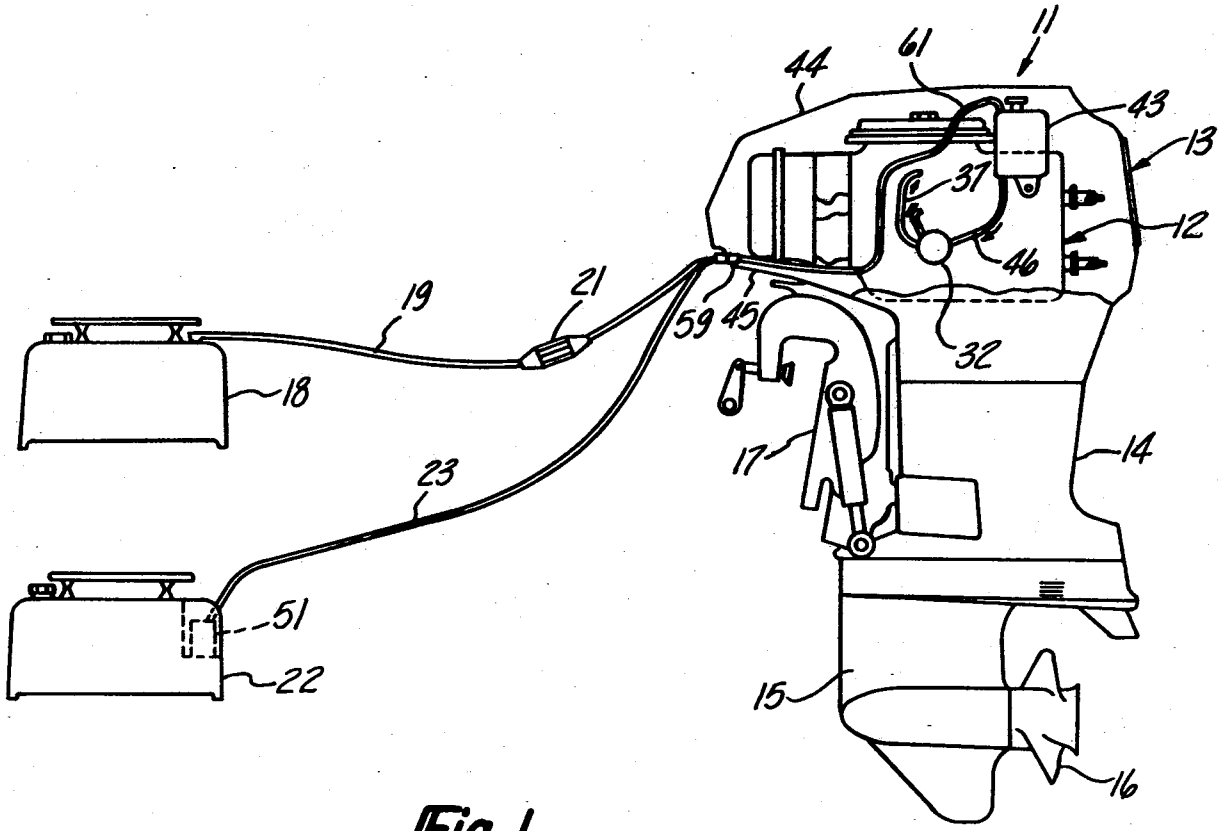
FIG. 1 is a side elevational view, with portions broken away, showing an outboard motor equipped with this invention.

Referring first to FIG. 1, the invention is illustrated as being embodied in an outboard motor, indicated generally by the reference numeral 11. The outboard motor 11 includes a powerhead consisting of a two cycle, multicylinder internal combustion engine 12 that is positioned within a protective cowling, indicated generally by the reference numeral 13. The engine 12 has a drive shaft, to be described, which extends downwardly through a drive shaft housing 14 and which terminates in a lower unit 15 that drives a propeller 16 in a known manner. The motor 11 is provided with a mounting assembly 17 so that the motor 11 may be attached in a known manner to the transom of an associated boat.

The motor 11 is provided with a separate external fuel tank 18 that is connected by means of a conduit 19 and mechanical pump 21 to the carburetion system of the engine 12 in a known manner.

In addition, a separate external lubricant supply tank 22 is provided that is connected by means of a conduit 23 to the lubricating system of the engine 12 in a manner to be described.

Figure 2:
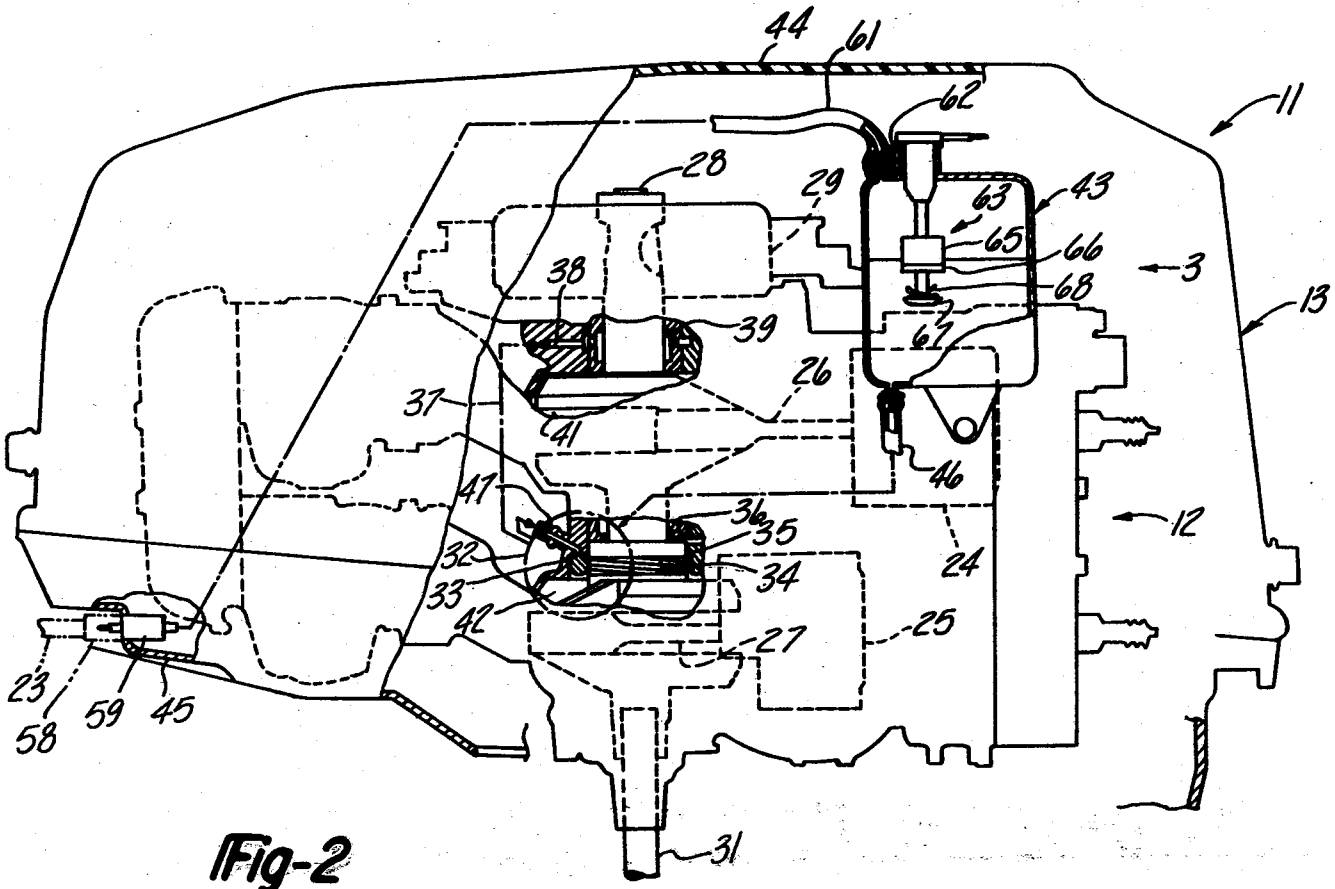
FIG. 2 is an enlarged view of the powerhead of the motor, with portions broken away, showing more details of the lubricating system.
Figure 3:
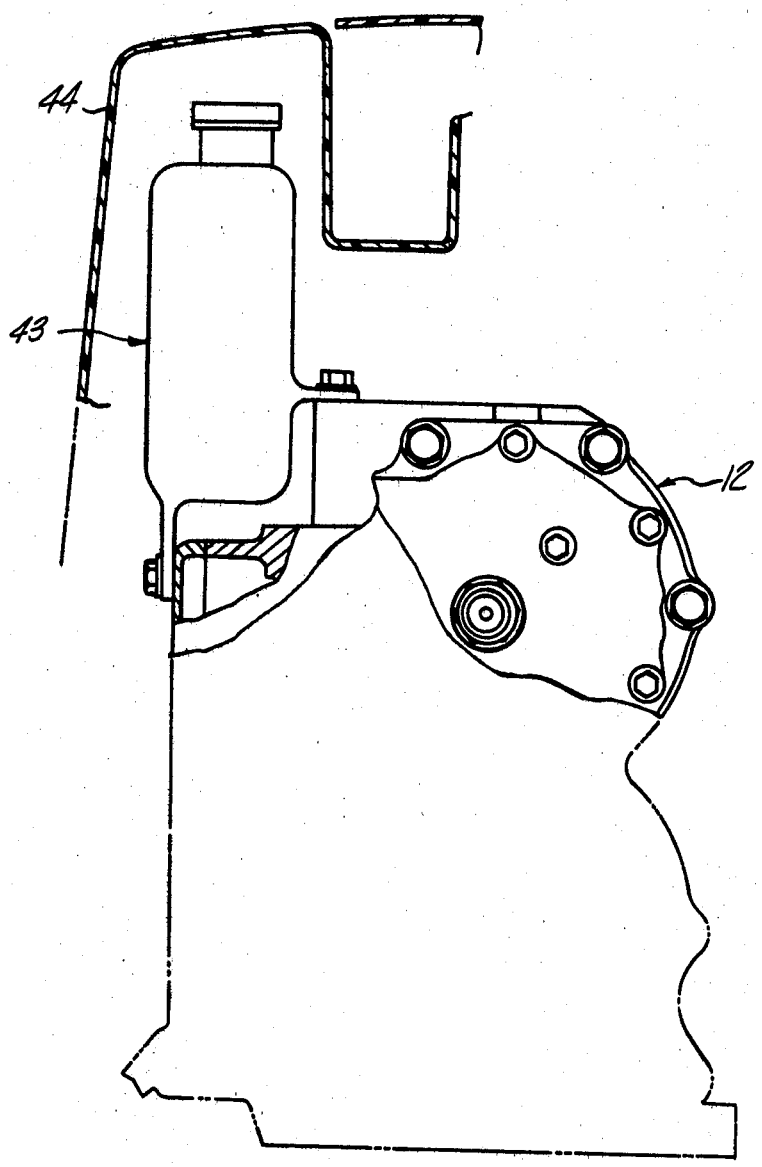
FIG. 3 is an elevational view taken in the direction of the arrow 3 in FIG. 2.

Referring now additionally to FIG. 2, the engine 12 is of the two cylinder, two cycle, in line type and includes a pair of pistons 24 and 25 that are connected by means of connecting rods 26 and 27 to the throws of a crank shaft 28 that is vertically disposed. The crank shaft 28 has mounted at its upper end a flywheel and magneto 29. The lower end of the crank shaft 28 is connected in a suitable manner to a drive shaft 31 which, as has been noted, extends through the drive shaft housing 14 and drives the lower unit 15 in a known manner.

The engine 12 is provided with an internal pressure and gravity lubricating system, which may be of the type described in my co-pending application entitled LUBRICATING SYSTEM FOR OUTBOARD ENGINE, Ser. No. 277,698, filed June 26, 1981 and assigned to the Assignee of this application. Generally, the lubricating system includes an oil pump 32 that has an input shaft to which is affixed a drive gear 33 that meshes with a driving gear 34 formed on the crank shaft 28 immediately below its center main bearing portion 35. A seal 36 is carried by the engine above the bearing portion 35. As described in my aforenoted patent application, the pump 32 has a pressure outlet conduit, indicated schematically at 37 that supplies oil under pressure to a lubricating passage 38 for supplying lubricant to the upper main bearing 39 of the crank shaft 28. This lubricant, in addition to lubricating the bearing 39, flows down the cheeks 41 of the crank shaft associated with the connecting rod 26 to lubricate the components associated with the connecting rod 26. The lubricating oil is then transferred into the combustion chamber associated with the piston 24 so that remaining lubricant may be burned and discharged to the atmosphere through the exhaust system.

A somewhat similar system, as described in my aforenoted patent application, is also provided for delivering lubricant to the crank shaft journal 35 for delivery to the cheeks 42 of the crank shaft 28 associated with the connecting rod 27. This lubricating oil is then delivered to the cylinder associated with the piston 25 so that it will be burned.

Lubricant is delivered to the oil pump 32 from a relatively small lubricant delivery tank, indicated generally by the reference numeral 43. The delivery tank 43 is supported by the engine 12 at a location higher than the oil pump 32 for delivery by gravity feed. The delivery tank 43 is relatively small so that it can be concealed within the cowling 13 between an upper cowling element 44 and a lower tray element 45 that are affixed to each other in a known manner so as to enclose the engine 12 and oil delivery tank 43. A conduit 46 extends from the lower end of the oil delivery tank 43 to an inlet fitting 47 of the oil pump 32 so that lubricant can be delivered to the oil pump 32 under gravity feed. This assures that there will always be a supply of lubricant delivered to the oil pump 32, even when the engine 12 is first started.

Figure 4:
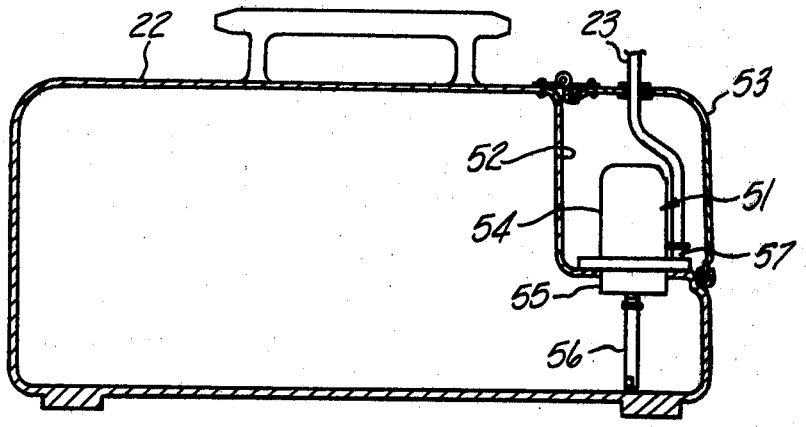
FIG. 4 is a cross sectional view taken through the external oil storage tank.

In order to maintain the oil delivery tank 43 as small as possible so as to avoid unnecessary enlargement of the cowling 13 and still insure an adequate supply of lubricant at all running speeds and when the engine 12 is operated for a long period of time, an arrangement is provided for transferring lubricant from the supply tank 22 to the delivery tank 43. Referring additionally to FIG. 4, this lubricant transfer system includes an intermittently driven electric pump, indicated generally by the reference numeral 51 which is positioned in part within a recess 52 formed in one corner of the lubricant supply tank 22. The pump cavity 52 is enclosed by means of an access cover 53 so as to protect the pump 51 while at the same time affording access to it for service.

The pump 51 includes an electric motor 54 which drives a suitable pump 55. The pump 55 has an inlet pipe 56 that depends into the lubricant cavity of the supply tank 22 and terminates adjacent its lower surface. The pump 55 further has an outlet fitting 57 to which one end of the conduit 23 is connected.

At its upper end, the conduit 23 has a quick disc connect coupling 58 that is adapted to be connected to a coupling 59 carried by the power head 12. The engine mounted coupling 59 is at one end of the conduit 61 which discharges to an inlet nipple 62 formed at the upper end of the supply tank 43.

Figure 5:
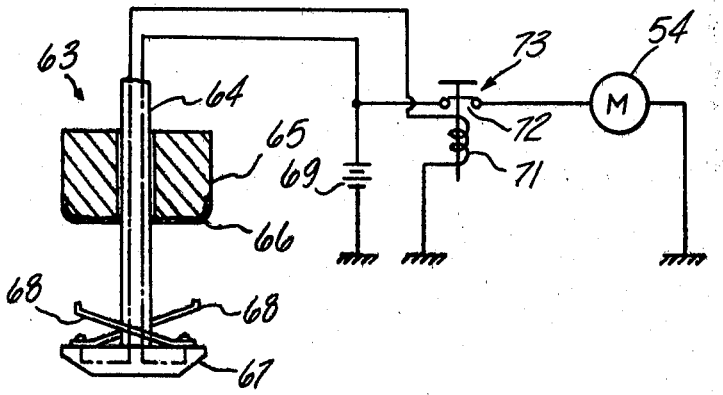
FIG. 5 is a schematic electrical diagram showing one embodiment of the invention.

An arrangement is provided to insure that the oil level in the supply tank 43 is maintained no less than a predetermined level. This is done, in the illustrated embodiments, by providing a float operated switching assembly that intermittently operates the motor and pump assembly 51. In accordance with a first embodiment of this invention, a float operated switch assembly, indicated generally by the reference numeral 63, is provided in the lubricant supply tank 43. The float operated switch assembly 63 is shown in more detail in FIG. 5 wherein the electrical schematic showing the connection with the motor 54 is also illustrated. The float operated switch 63 includes a central post 64 that is affixed in any known manner to the supply tank 43 and which depends into its interior. An annular float 65 is supported on the post 64 and has a conductive lower surface 66. At the lower end of the post 64 there is a stop member 67 provided to which are affixed a pair of terminals 68. The terminals 68 are in circuit with a battery 69 and a relay coil 71. The coil 71 operates the contacts 72 of a electrically operated switch 73 which connects the motor 54 selectively in circuit with the battery 69.

The operation of this embodiment is as follows. When the oil level in the supply tank 43 is above the predetermined minimum level as set by the stop 67, the float 65 and specifically its conductive portion 66 would be out of contact with the terminals 68. The switch 73 is normally opened and the pump motor assembly 51 will not be driven. During running of the engine the oil pump 32 will draw oil from the delivery tank 43 by gravity feed for lubricating the engine 12. As the level in the delivery tank 43 falls the float 65 will approach the contacts 68 and eventually the conductive portion 66 will complete the circuit between the contacts 68 due to the diminished oil level. The coil 71 will then be energized to close the switch 73 and energize the motor 54 associated with the electrically driven pump 55. Oil will then be delivered by the pump assembly 51 through the conduit 23 connectors 58 and 59 and conduit 61 to the delivery tank 43. Once the level in the tank 43 has been raised sufficiently, the float 65 will come out of contact with the terminals 68 and the coil 71 will be de-energized. The switch 73 will then be biased to its open position and the motor 54 will stop. This sequence will be repeated during the running of the engine so as to insure that there is an adequate supply of lubricant at all times.

Because the pump 55 is located in the lubricant supply tank 22 it will be insured that the pump inlet 56 is always supplied with oil. Therefore, the pump 55 will never operate dry, nor will it loose prime. Thus, it is insured that lubricant will always be present in the delivery tank 43 and complete lubrication of the engine is insured.

FIG. 6 shows another embodiment of the invention wherein a time delay circuit, indicated generally by the reference numeral 101, is provided in the circuit between the terminal 68 and the coil 71. In all other regards this embodiment is the same as that of FIG. 5 and, for that reason, common parts have been identified by the same reference numerals and will not be described again. The time delay circuit 101 which may be of any type such as one embodying a one shot multi-vibrator, holds the circuit completed through the coil 71 once the terminal 68 are contacted by the conductive plate 66 for a predetermined period of time so that the pump will be operated for that predetermined period of time even after the float 65 moves to a sufficient level so as to bring the plate 66 out of contact with the terminal 68. This insures that the oil level in the delivery tank 43 may be raised sufficiently so as to lengthen the duty cycle of the pump 51 and to minimize cycling of it.

Rather than operating the motor 54 of the electric pump and motor assembly 51 when the level in the tank 43 reaches a predetermined minimum level, an arrangement may be provided to insure that the level in the supply tank 43 is at a predetermined maximum level. Such an arrangement is shown in FIG. 7.

In accordance with this embodiment, a post 111 is again carried in any suitable manner by the delivery tank 43. The post 111 has a lower most stop 112 and a float 113 is slidably supported on the post 111 between the stop 112 and an upper stop 114. The upper stop 114 carries a pair of terminals 115 which, with a conductive plate 116 carried by the upper most surface of the float 113 comprise a switch assembly, indicated generally by the reference numeral 117. The terminals 115 are in circuit with a battery 118 and a coil 119 of an electrically operated switch 121. The switch 121 has a contactor 122 that is normally biased to a closed position so as to complete a circuit between the battery 118 and the motor 54 of the electrically driven pump assembly 51.

In accordance with this embodiment, when the level in the delivery tank 43 is below the predetermined level the float 113 will move to a position as shown in FIG. 7 wherein the float conductive plate 116 is not in contact with the terminals 115. Thus, there will be no current flow through the coil 119 and the switch 121 will be in its normally closed condition. Thus, the motor 54 will be operated so that the pump assembly 51 delivers oil from the supply tank 22 to the delivery tank 43. When the oil level rises sufficiently, the float 113 will move upwardly on the post 111 until its conductive plate 116 completes the circuit with the terminals 115. The coil 119 will then be energized to open the switch 121 and stop the operation of the motor 54. When the oil supply in the delivery tank 43 is depleted sufficiently for the float 113 to drop out of contact with the terminals 115, the holding coil 119 will be released and the switch 121 closed to reinstitute operation of the motor 54 and pump assembly 51.

It should be readily apparent that several embodiments of the invention have been disclosed which insure adequate supply of lubricating oil to the engine under all conditions without necessitating the use of an unduly large oil delivery tank carried by the engine. Also, each embodiment provides an arrangement which insures that the supply pump will never run out of prime and will always deliver oil to the supply tank when required. Although several embodiments have been disclosed, it is believed to be clear that still further modifications of the invention are possible. For example, the electric motor of the pump may be operated by a pair of switches that determine maximum and minimum oil in the delivery tank 43 so as to initiate running of the pump when the oil level falls below a predetermined level and to shut the pump off when the oil level reaches a predetermined maximum level. This modification and others are believed to be well within the scope of those skilled in the art, without departing from the spirit and scope of the invention, as defined by the appended claims.

I claim:

1. In a lubricating system for a two cycle engine comprising a lubricant delivery system for delivering lubricant to the engine, a relatively small delivery tank for supplying lubricant therefrom to said lubricant delivery system, and a separate, larger capacity lubricant storage tank, the improvement comprising pumping means located in said storage tank for pumping lubricant from said storage tank into said delivery tank.

2. A lubricating system as set forth in claim 1, further including means responsive to the level of the liquid in the delivery tank for actuating the pumping means to maintain a predetermined level in the delivery tank.

3. A lubricating system as set forth in claim 2, wherein the means responsive to the liquid level actuates the pumping means when the liquid level in the delivery tank falls below a predetermined level.

4. A lubricating system as set forth in claim 2, wherein the means responsive to the liquid level effects discontinuance of the operation of the pumping means when the level in the delivery tank exceeds a predetermined level.

5. A lubricating system as set forth in claim 4, further including means for operating the pumping means when the liquid level in the delivery tank falls below a predetermined value.

6. A lubricating system as set forth in claim 3, wherein the means for operating the pumping means is effective to operate the pumping means for a predetermined period of time after the liquid level in the delivery tank falls below the predetermined level.

7. A lubricating system as set forth in any of claims 1 through 6 wherein the lubricant delivery system further includes an oil pump driven by the engine.

8. A lubricating system as set forth in claim 7 when the pumping means comprises an intermittently operated electrically driven pump.

9. In a lubricating system for a two cycle engine comprising a lubricant delivery system for delivering lubricant to the engine, a relatively small delivery tank for supplying lubricant therefrom to said lubricant delivery system, a separate large capacity lubricant storage tank, and pumping means for pumping liquid from said lubricant storage tank to said delivery tank, the improvement comprising said pumping means being operative in response to the liquid level in said delivery tank for maintaining a predetermined level therein.

10. A lubricating system as set forth in claim 9, wherein the means responsive to the liquid level actuates the pumping means when the liquid level in the delivery tank falls below a predetermined level.

11. A lubricating system as set forth in claim 9, wherein the means responsive to the liquid level effects discontinuance of the operation of the pumping means when the level in the delivery tank exceeds a predetermined level.

12. A lubricating system as set forth in claim 11, further including means for operating the pumping means when the liquid level in the delivery tank falls below a predetermined value.

13. A lubricating system as set forth in claim 10, wherein the means for operating the pumping means is effective to operate the pumping means for a predetermined period of time after the liquid level in the delivery tank falls below the predetermined level.

14. A lubricating system as set forth in any of claims 9 through 13 wherein the lubricant delivery system further includes an oil pump driven by the engine.

15. A lubricating system as set forth in claim 14 when the pumping means comprises an intermittently operated electrically driven pump.

16. A lubricating system as set forth in claim 7 wherein the engine is enclosed within a protective cowling, the delivery tank being contained within said protective cowling and the lubricant storage tank being positioned externally of the protective cowling.

17. A lubricating system as set forth in claim 16 further including conduit means including a detachable coupling carried in part by the protective cowling for conveying lubricant from the lubricant storage tank to the delivery tank.

18. A lubricating system as set forth in claim 16 further including a lubricant pump driven by the engine for delivering lubricant to components of the engine, the delivery tank being in fluid communication with the inlet to said lubricant pump.

19. A lubricating system as set forth in claim 18 wherein the lubricant pump delivers under pressure to at least certain bearings of the engine.

20. A lubricating system as set forth in claim 7 further including a lubricant pump driven by the engine for delivering lubricant to components of the engine, the delivery tank being in fluid communication with the inlet to said lubricant pump.

21. A lubricating system as set forth in claim 20 wherein the lubricant pump delivers lubricant under pressure to at least certain bearings of the engine.

22. A lubricating system as set forth in claim 14 wherein the engine is enclosed within a protective cowling, the delivery tank being contained within said protective cowling and the lubricant storage tank being positioned externally of the protective cowling.

23. A lubricating system as set forth in claim 22 further including conduit means including a detachable coupling carried in part by the protective cowling for conveying lubricant from the lubricant storage tank to the delivery tank.

24. A lubricating system as set forth in claim 14 wherein the oil pump driven by the engine supplies oil under pressure to at least some bearings of the engine.

* * * * *

UNITED STATES PATENT AND TRADEMARK OFFICE

CERTIFICATE OF CORRECTION

PATENT NO. : 4,403,578

DATED : September 13, 1983

INVENTOR(S) : Tomio Iwai; Motoi Tobinaga

It is certified that error appears in the above-identified patent and that said Letters Patent is hereby corrected as shown below:

Column 7, line 21, claim 19

After "delivers" insert --lubricant--.

Signed and Sealed this

*Twenty-first* Day of *February 1984*

[SEAL]

*Attest:*

GERALD J. MOSSINGHOFF

*Attesting Officer*

*Commissioner of Patents and Trademarks*